US005535487A

United States Patent [19]

Kageyama et al.

[11] Patent Number: 5,535,487

[45] Date of Patent: Jul. 16, 1996

[54] CLIP ATTACHMENT APPARATUS FOR A WRITING INSTRUMENT

[75] Inventors: Hidehei Kageyama, Kawagoe; Tadayoshi Ebinuma, Hohya, both of Japan; Allen Drucker, Farmingham, Mass.

[73] Assignee: The Gillette Company, Boston, Mass.

[21] Appl. No.: 338,633

[22] PCT Filed: Aug. 24, 1993

[86] PCT No.: PCT/US93/07950

§ 371 Date: Feb. 22, 1995

§ 102(e) Date: Feb. 22, 1995

[87] PCT Pub. No.: WO94/05513

PCT Pub. Date: Mar. 17, 1994

[30] Foreign Application Priority Data

Sep. 4, 1992 [JP] Japan ..... 4-062431
Feb. 2, 1993 [JP] Japan ..... 5-002336

[51] Int. Cl.[6] ..... B43K 25/00

[52] U.S. Cl. ..... 24/11 F; 24/11 R; 24/11 S

[58] Field of Search ..... 24/11 F, 11 R, 24/11 P, 11 M, 11 HC, 11 S, 11 CC, 11 CT, 11 C, 10 R

[56] References Cited

U.S. PATENT DOCUMENTS

| | | | |
|---|---|---|---|
| 1,314,104 | 8/1919 | Wahl | 24/11 F |
| 1,720,471 | 7/1929 | Fritsch . | |
| 1,854,747 | 4/1932 | France | 24/11 F |
| 3,842,466 | 10/1974 | Katz et al. | 24/11 F |
| 4,653,154 | 3/1987 | Malm | 24/11 R |
| 4,926,525 | 5/1990 | Eylers | 24/11 F |

FOREIGN PATENT DOCUMENTS

| | | | |
|---|---|---|---|
| 1428677 | 1/1966 | France . | |
| 2929938 | 2/1981 | Germany . | |
| 3234514 | 3/1984 | Germany . | |
| 0420164 | 11/1934 | United Kingdom | 24/11 F |

*Primary Examiner*—Victor N. Sakran
*Attorney, Agent, or Firm*—Fish & Richardson

[57] ABSTRACT

A writing instrument slip attachment mechanism is disclosed which prevents the clip (3) from becoming separated from the writing instrument. The clip attachment mechanism located on the writing instrument shaft (1) includes a clip (3) having a folded back base section (4); and a clip attachment section (2) having cooperatively shaped outer and inner surfaces (2A, 2B) for operatively engaging said folded back base section (4); and a cover (5) for attachment to said clip attachment to said clip attachment section (2). The base section (4) of the clip (3) is press-fitted into the outer and inner surfaces (2A, 2B) of the clip attachment (2). The cover (5) cover the press-fitted base section (4) and preferably also helps to lock the base section (4) to the clip attachment section (2), by use of co-operatively shaped convex and concave surfaces formed between the cover and clip attachment section (2).

8 Claims, 5 Drawing Sheets

CLIP ATTACHMENT APPARATUS FOR A WRITING INSTRUMENT

TECHNICAL FIELD

The present invention relates to a clip attachment apparatus for a writing instrument.

BACKGROUND ART

In previous clip attachment mechanisms, at the outer surface of the rear of the shaft, the radial base section of the forward-extending clip attachment section was formed as a whole, and a clip base section was inserted and fixed into an insertion hole which opened at the end of the forward-extending clip attachment section.

However, in the above example of prior art, because it is a construction in which a clip base section is inserted and fixed into an insertion hole which opens forwardly at the end of the clip attachment section, there are cases in which the fit of the clip base section and the insertion hole is loose due to such factors as dimensional errors, and there are problems such as the lateral shaking and dropping out of the clip.

DISCLOSURE OF INVENTION

According to the present invention there is provided a writing instrument clip attachment mechanism formed by the press fitting of the folded back base section of the clip into the outer and inner surfaces of the clip attachment section of the shaft and by the attachment of a cover which covers (and also preferably helps lock) said folded back base section to the clip attachment section.

In this way, the folded back base section of the clip is press fit into the inner and outer surfaces of the clip attachment section, so there is no danger of the fit of the clip becoming loose, and the lateral shaking and dropping out of the clip can be prevented. Moreover, the external appearance is not compromised because the folded back base section of the clip is covered with the cover.

It is therefore an object of the invention to provide a clip attachment structure that locks the clip relative to the structure.

It is a feature of the clip attachment structure to include an opening for receiving the bent end of the clip, and to provide a cover that preferably prevents the bent portion of the clip from withdrawing from the opening.

BRIEF DESCRIPTION OF THE DRAWINGS

The invention will now be described with reference to the accompanying drawings, in which.

DESCRIPTION OF THE PREFERRED EMBODIMENT

Figure 1A:
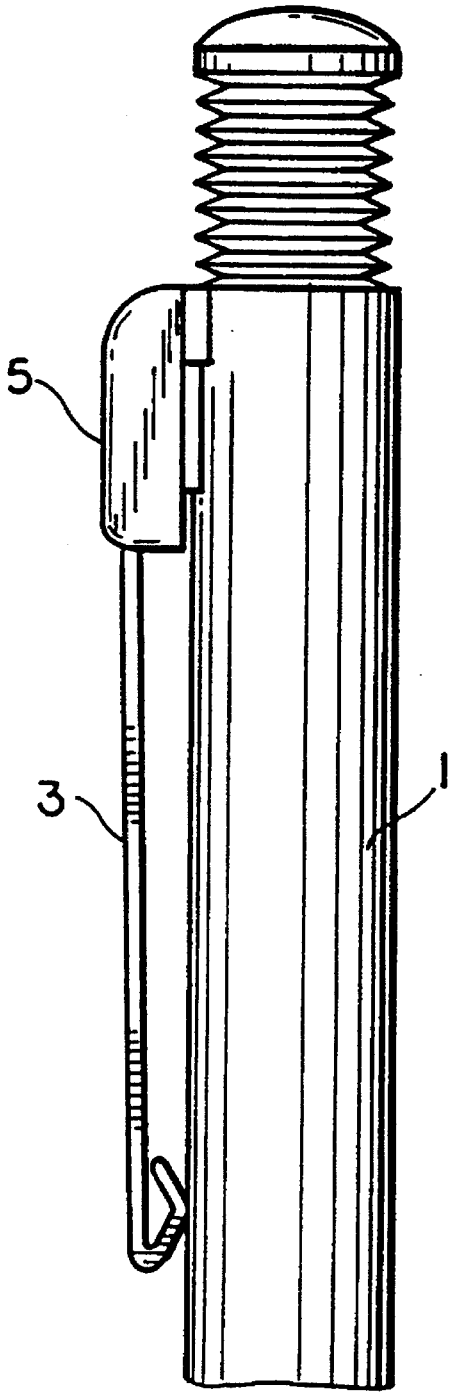
FIG. 1A is a pictorial side view showing a first embodiment of the mechanism of the present design.

Referring now to the drawings, the construction will be explained.

Figure 1B:
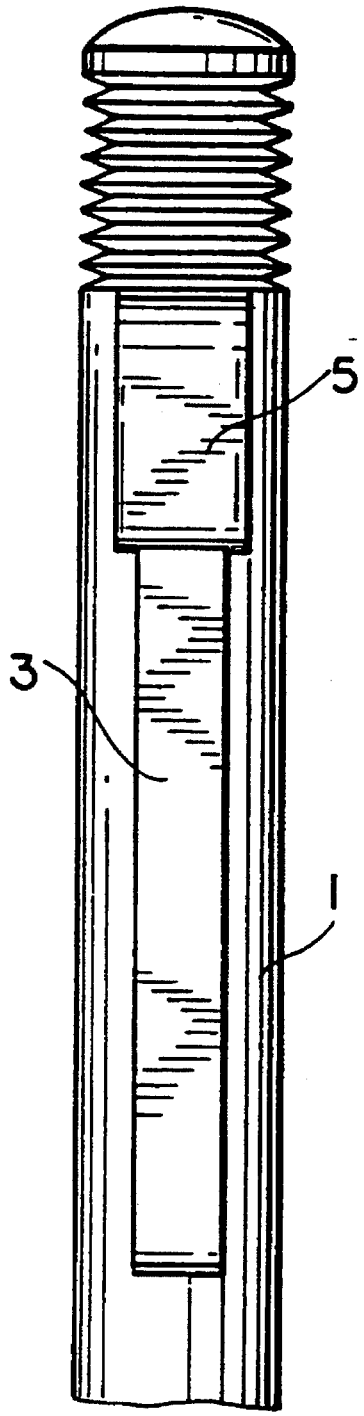
FIG. 1B is a front view of the same.
Figure 2A:
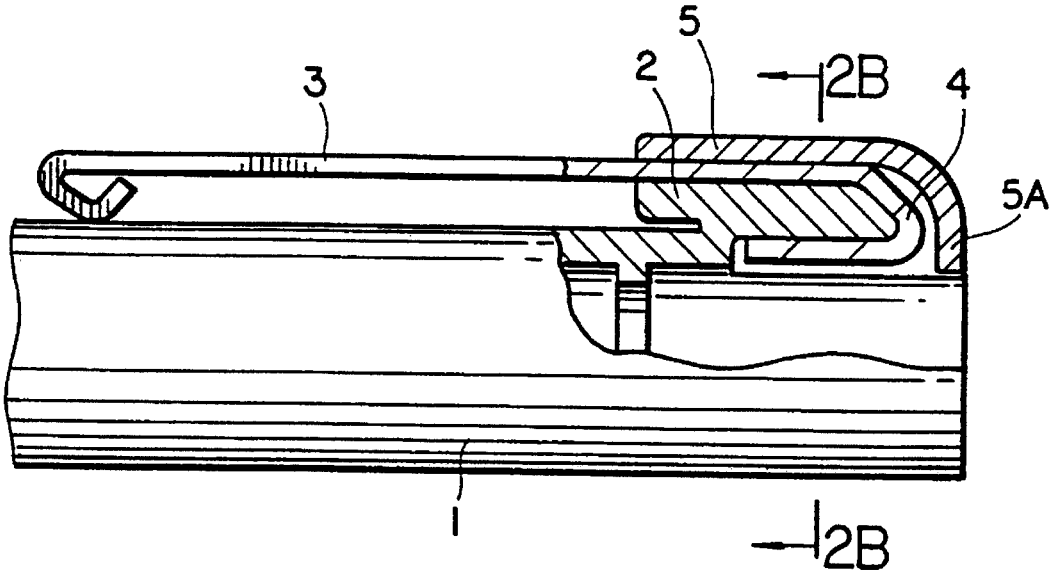
FIG. 2A is a side view in partial cross section which shows the construction of the mechanism of the present invention.
Figure 2B:
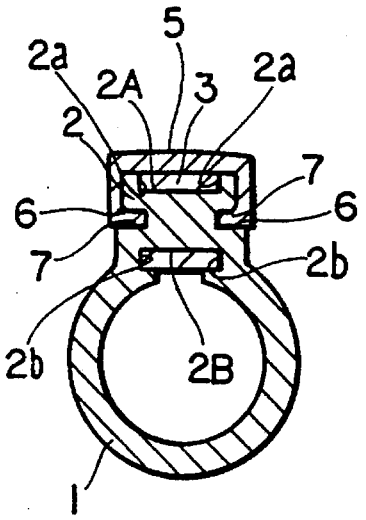
FIG. 2B is a cross section taken at lines 2B—2B of FIG. 2A.

In FIGS. 1 and 2 of a first embodiment, 1 is the writing instrument shaft, 2 is the clip attachment section which is formed on the upper part of the rear of the shaft 1, 2A and 2B are the outer and inner surfaces of this clip attachment section 2 respectively, and **2*a* and 2*b* are the pair(s) of clip attachment grooves which are positioned adjacent the outer and inner surfaces 2A, 2B of the clip attachment section 2** respectively.

The folded back base section 4 of the clip 3 is press fit into the clip attachment grooves **2*a*, 2*b* of the clip attachment section 2. A cover attachment groove 6 is formed on the surfaces on both sides of the clip attachment section 2, a cover attachment protrusion section 7 is formed on the inner surfaces of both sides of the cover 5, the cover attachment protrusion section 7 is fit into each of the cover attachment grooves 6 of the clip attachment section 2, and the cover 5 is attached onto the clipped attachment section 2**.

Figure 2C:
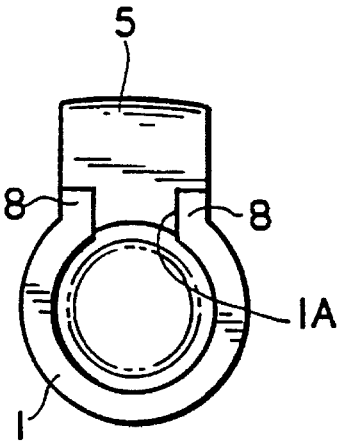
FIG. 2C is an end view of FIG. 2A.

In the embodiment shown in FIGS. 1A and 2C the protrusion section 8 is positioned opposite the shaft slit section 1A behind the clip attachment section 2, and the rear section 5A of the cover is attached to the upper surface and the inner surfaces of both sides of the protrusion section 8.

Figure 3A:
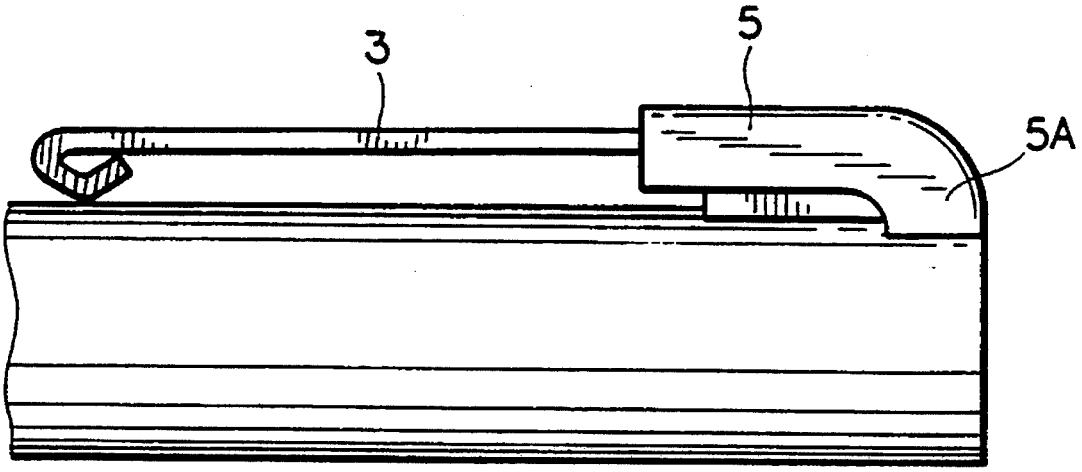
FIG. 3A is a side view of a second embodiment.
Figure 3B:
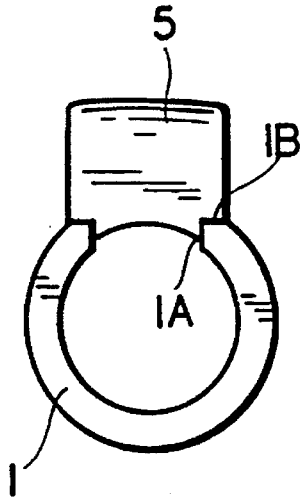
FIG. 3B is an end view of the embodiment of FIG. 3A.

In the second embodiment shown in FIG. 3, a notched surface 1B is formed opposite the shaft slit section 1A behind the clip attachment section 2, and the rear section 5A of the cover is attached to this notched surface 1B and to the shaft slit section 1A. In this embodiment, the rear section of the shaft slit section 1A is covered by the rear section 5A of the cover, so the instrument becomes even more attractive.

Next, the action of the two embodiments above will be explained.

The folded back base section 4 of the clip 3 is press fit into the clip attachment grooves **2*a*, 2*b* of the clip attachment section 2, so there is no danger of the fit of the clip 3 becoming loose, and the lateral shaking and dropping out of the clip 3 can be prevented. Moveover, the external appearance is not compromised because the folded back base section 4 of the clip 3 is covered with the cover 5**.

Figure 4A:
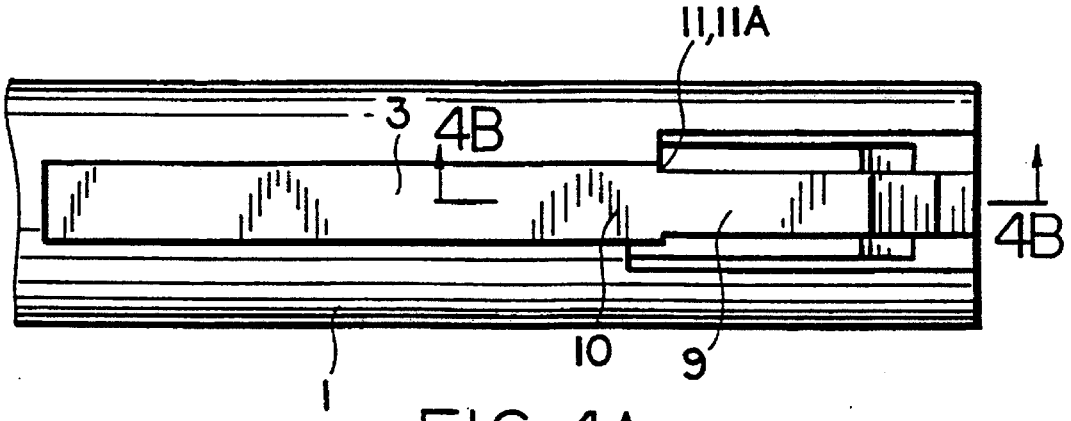
FIG. 4A is a top view which shows the upper half of the first embodiment and the lower half of a second embodiment, without a cover attached.
Figure 4B:
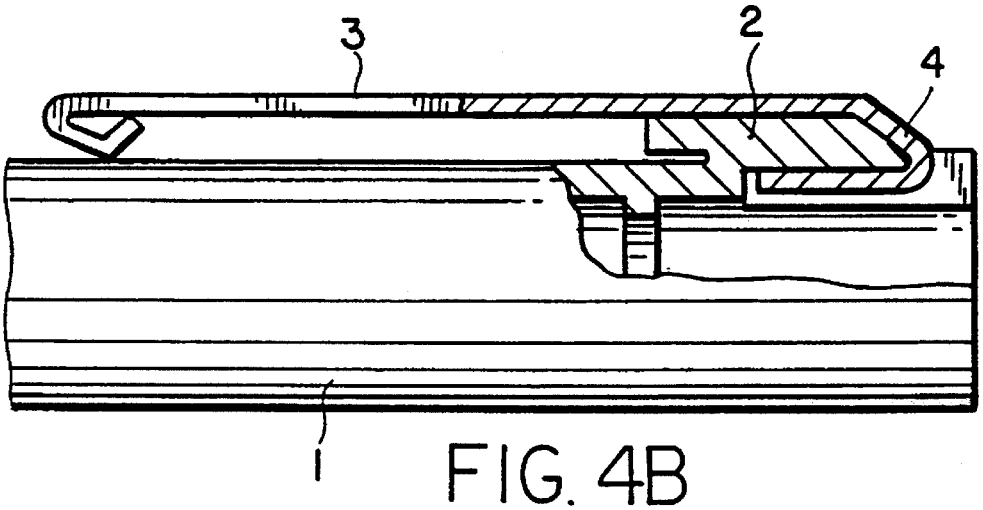
FIG. 4B is a partial cross section taken through FIG. 4A, along lines 4B—4B.
Figure 4C:
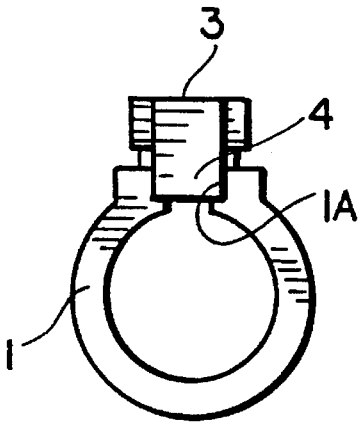
FIG. 4C is an end view of FIG. 4A.

As shown in FIG. 4, a narrow section 9 is formed on the upper surface of the folded back base section 4 of the clip 3, this narrow section 9 is attached to both sides of the upper portion of the clip attachment section 2, and through a construction in which the step sections 11 of the narrow 9 and wide sections 10 are stopped by the step sections 11A of the corresponding clip attachment section 2, the slipping out of the clip 3 toward the rear can be reliably prevented.

BEST MODE FOR CARRYING OUT THE INVENTION

FIG. 5 shows a preferred third embodiment of the invention. FIG. 5A is a side view which shows the clip attachment section 2 and the shaft i in a condition where the cover and the clip are not attached. FIG. 5B is a cross section taken at line E—E of FIG. 5A. Moreover, FIG. 5C is a vertical partial cross section of the cover, and FIG. 5D is the bottom view of the cover.

Figure 5A:
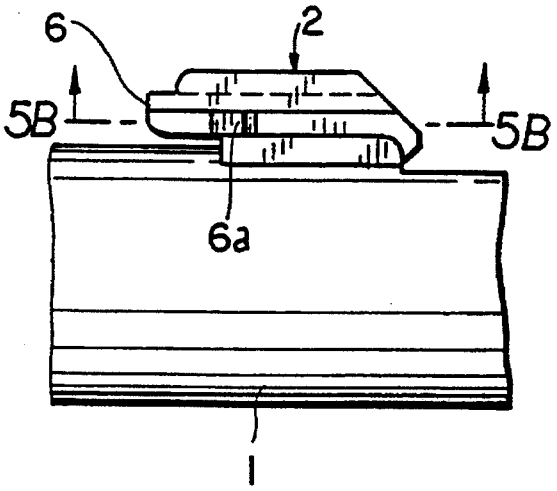
FIG. 5A is a side view of a third embodiment which shows the clip attachment section in a condition where the cover and the clip are not attached.
Figure 5B:
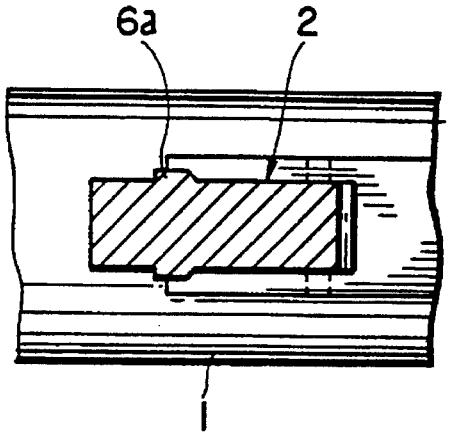
FIG. 5B is a cross section taken at line E—E of FIG. 5A.
Figure 5C:
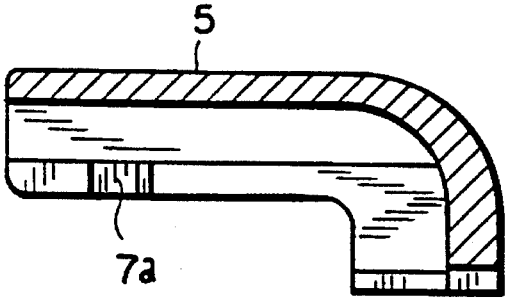
FIG. 5C is a vertical cross section of the cover.
Figure 5D:
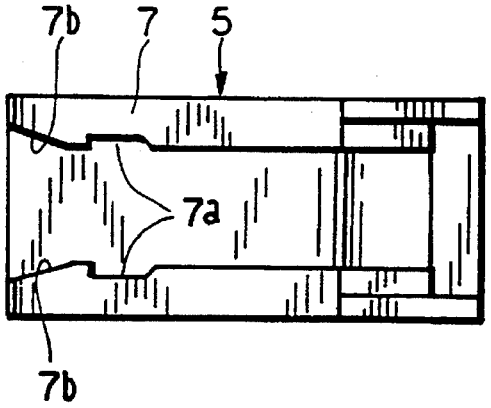
FIG. 5D is a bottom view of the cover.

As seen in FIGS. 5A and 5B, a convex section 6*a* is formed on the bottom surface of the cover attachment groove 6 of the clip attachment section 2. On the other hand, on the inner surface of the cover attachment protrusion section 7 of the cover 5 which fits into this cover attachment groove 6, as seen in FIGS. 5C and 5D, a complimentary concave section 7*a* is formed at the position which corresponds to the convex section 6*a*, and this is made to dimensions which allow it to fit together with the convex section 6*a* of the clip attachment section 2. Moreover, a tapered section 7*b* is positioned on the inner side of the edge of the cover attachment protrusion section 7.

In order to attach cover 5 to the clip attachment section 2, the edge of the cover attachment protrusion section 7 is slid from the rear of the clip attachment section 2 along the cover attachment groove 6. After the edge of the cover attachment protrusion section 7 is attached to the convex section 6*a*, when the cover 5 is pressed again, the tapered section 7*b* expands somewhat toward the outside and goes over convex section 6*a*, and through the fitting together of concave section 7*a* and convex section 6*a*, the cover 5 is affixed to the clip attachment section 2. Through the fitting together of concave section 7*a* and convex section 6*a*, the connection between the two becomes secure, and it becomes difficult for the cover 5 to drop out of the clip attachment section 2.

In order to make the cover 5 easy to attach to the clip attachment section 2 and not easy to remove once it has been attached, it is desirable for the front end surfaces of the convex section 6*a* and the concave section 7*a*, respectively, to be formed so that they are almost perpendicular with respect to the shaft line of the writing instrument and for the rear end surfaces of the convex section 6*a* and the concave section 7*a*, respectively, to be formed so that they are at an angle with respect to the shaft line of the writing instrument.

It goes without saying that the same function will be obtainable even if the convex section is positioned on the cover side and the concave section is positioned on the clip attachment section side.

As mentioned above, through the present design, the folded back base section of the clip 3 is press fit into the outer and inner surfaces 2A, 2B of the clip attachment section 2, so there is no danger of the fit of the clip 3 becoming loose, and the lateral shaking and dropping out of the clip 3 can be prevented.

We claim:

1. A writing instrument clip attachment mechanism located on the shaft of said writing instrument, said clip attachment mechanism comprising a clip having a folded back base section, and a clip attachment section having cooperatively shaped outer and inner surfaces for operatively engaging said folded back base section, and a cover for attachment to said clip press fitted into the outer and inner surfaces of the clip attachment section, said cover covering said press-fitted folded back base section on the clip attachment section.

2. A writing instrument clip attachment mechanism according to claim 1, wherein said outer and inner surfaces of said clip attachment section further comprise adjacent clip attachment grooves, and said folded back base section of the clip press fitted into said clip attachment grooves.

3. A writing instrument clip attachment mechanism located on the shaft of said writing instrument, said clip attachment mechanism comprising a clip having a folded back base section, and a clip attachment section having cooperatively shaped outer and inner surfaces for operatively engaging said folded back base section, and a cover for attachment to said clip press fitted into the outer and inner surfaces of the clip of the clip attachment section, said cover covering said press-fitted folded back base section on the clip attachment section, wherein said cover comprises inner surfaces which attach to the outer surfaces of said clip attachment section, said clip attachment section outer surfaces further comprising the cover attachment groove and said cover inner surfaces further comprising the cover attachment protrusion section, where said cover attachment groove fits together with said cover attachment protrusion section.

4. A clip attachment mechanism according to claim 3, characterized by the positioning of a convex section at the bottom surface of the cover attachment groove and by the positioning of a co-operatively shaped concave section on the inner surface of the cover attachment protrusion section.

5. A clip attachment mechanism according to claim 3, characterized by the positioning of a concave section at the bottom surface of the cover attachment groove and by the positioning of a co-operatively shaped convex section on the inner surface of the cover attachment protrusion section.

6. A writing instrument clip attachment mechanism located on the shaft of said writing instrument, said clip attachment mechanism comprising a clip having a folded back base section, and a clip attachment section having cooperatively shaped outer and inner surfaces for operatively engaging said folded back base section, and a cover for attachment to said clip press fitted into the outer and inner surfaces of the clip attachment section, said cover covering said press-fitted folded back base section on the clip attachment section, further comprising a protrusion section positioned opposite the shaft slit section behind said clip attachment section and by the attachment of the rear section of said cover onto the upper surface and the inner surfaces of said protrusion section.

7. A writing instrument clip attachment mechanism located on the shaft of said writing instrument, said clip attachment mechanism comprising a clip having a folded back base section, and a clip attachment section having cooperatively shaped outer and inner surfaces for operatively engaging said folded back base section, and a cover for attachment to said clip press fitted into the outer and inner surfaces of the clip attachment section, said cover covering said press-fitted folded back base section on the clip attachment section, further comprising a notched surface opposite the shaft slit section behind said clip attachment section and the rear section of said cover fitting onto said notched surface and shaft slit section.

8. A writing instrument clip attachment mechanism located on the shaft of said writing instrument, said clip attachment mechanism comprising a clip having a folded back base section, and a clip attachment section having cooperatively shaped outer and inner surfaces for operatively engaging said folded back base section, and a cover for attachment to said clip press fitted into the outer and inner surfaces of the clip attachment section, said cover covering said press-fitted folded back base section on the clip attachment section, further comprising a narrow section formed on the upper surface of said folded back base section of said clip, wherein said narrow section is attached to the upper portion of said clip attachment section, and the step section of the wide and narrow sections is stopped by the corresponding step section of said clip attachment section.

* * * * *